US005342046A

United States Patent [19]

Erb

[11] Patent Number: 5,342,046

[45] Date of Patent: * Aug. 30, 1994

[54] INTERLOCKING RIGID, SPLIT GRIP FOR SOFTBALL AND BASEBALL BATS

[75] Inventor: Albert R. Erb, Ortley Beach, N.J.

[73] Assignee: Rotary-Grip TM, Inc., Island Heights, N.J.

[ * ] Notice: The portion of the term of this patent subsequent to Jul. 30, 2008 has been disclaimed.

[21] Appl. No.: 53,519

[22] Filed: Apr. 26, 1993

[51] Int. Cl.[5] ..... A63B 59/06

[52] U.S. Cl. ..... 273/72 R; 273/72 A

[58] Field of Search ..... 273/72 R, 72 A, 26 B, 273/81 C, 81 B

[56] References Cited

U.S. PATENT DOCUMENTS 5,035,428 7/1991 Bartkowicz ..... 273/72 R

*Primary Examiner*—Mark S. Graham

*Attorney, Agent, or Firm*—Stephen W. White

[57] ABSTRACT

A novel, rigid and interlocking split grip, swing enhancing device suitable for use with a baseball or a baseball bat is described. This device is made from a hard, durable, and semi-pliable plastic material and can be installed under a conventional gripping sleeve commonly found on most baseball or softball bats. The device is installed in the proper place on the bat and the interlocking mechanism activated. When placed under one of the user's hand location (the upper or guiding hand) this device will insure a smooth and level swing and the proper alignment of the hands through the swing allowing the bat to make better contact with the ball. The device can be installed during the manufacture of the bat or can be added later.

7 Claims, 1 Drawing Sheet

INTERLOCKING RIGID, SPLIT GRIP FOR SOFTBALL AND BASEBALL BATS

BACKGROUND OF THE INVENTION

1. Cross-reference to Related Applications

This application is related to U.S. Pat. Nos. 5,011,145 and 5,035,428 and to my co-pending applications U.S. Ser. Nos. 07/829,269, filed Feb. 3, 1992, (now allowed), and 07/853,572, filed Mar. 18, 1992. All of these previous references describe rotating gripping means for improving the handling and performance of baseball bats. This application is drawn to a similar device but one which is improved by being stronger, rigid and which can be used by stronger and more powerful batters.

2. Field of the Invention

This invention is related to the game of baseball and softball and specifically to bats used to play said game. Still more specifically, this invention is related to an improved grip that may be applied to the handles of baseball or softball bats to achieve improved swings thereof and to withstand extreme pressure and twisting and distorting the shape of the device from the grip of the user. Finally, this invention relates to an improved, rigid, interlocking rotating grip that can be manufactured simply and inexpensively and easily installed on the handle of a baseball or softball bat.

3. Discussion of the Prior Art

There are a number of prior art references that describe how bats are used to play the game of baseball and softball. There are also a number of other prior references that relate to batting devices employed to play other games. Baseball and softball is, however, a unique game in which one team uses a player (the "pitcher") who employs a ball that is thrown, sometimes at very high speeds, towards an opposing player (the "batter") who uses a small object (e.g., a baseball or softball bat) to try and strike the ball to a designated place on the playing surface. It is a difficult chore to strike this ball for a number of reasons. The primary reason is that is very difficult simply to hit the ball because of its size and speed of delivery. Additionally, the pitcher can employ a hurling or throwing delivery that will cause the ball to dip or curve in various directions. Consequently, a level, smooth and consistent swing is a necessity in order for the batter to get the bat to meet the ball squarely and thus perform his or her function.

There are several forms and types of baseball and softball played and these games may be played by amateurs or by professionals. For example, hardball baseball is played by professional teams throughout the United States, Canada, Mexico, South America, Cuba and in the Far Eastern countries, for example. There are major league teams as well as minor league teams who perform for pay. In addition, this game is played in colleges, high schools and by Youth League Teams throughout the aforementioned countries. Then, there are adult male and female and youth recreational softball teams who employ a larger, softer ball. All, however, use a bat of similar shape and varying sizes and weights within their individual games.

A baseball or softball bat usually is made up of three parts. There is an end, sometimes called the "barrel" that is used to strike the ball and this part is usually the largest part of the bat having the greatest diameter. There is also a handle end that is gripped by the batter when hitting or striking the ball during the game. Additionally, there is a knob usually located at the end of the handle that is used to assist the user and to insure that the bat does not slip through the user's hands when swinging. Many bats are made from wood but it is conventional in this day and age to employ bats made from aluminum or composites such as graphite or ceramics since they will last longer during play and can be manufactured more easily and with a greater degree of consistency than wooden bats. Most of the bats used in the amateur ranks and in softball employ the aluminum bat and most of these have some sort of cover over the handle to assist in gripping the bat. These covers are conventionally applied just above the aforementioned knob. This cover is conventionally a sleeve of some sort that is applied to the handle during the manufacture thereof. The cover may be of rubber or plastic and sometimes leather is used. The cover is used to assist in the ultimate gripping of the bat and to insure that said grip is firm.

Additionally, in the aforementioned references there are described numerous other devices employed in the prior art to improve the swing of various hitting devices found within the sporting world. These include gripping means for golf clubs, tennis racquets, for example. None of these prior art references teach how to improve the swing of a baseball bat.

In the specifically mentioned U.S. patents and applications cross-referenced above, there are described three separate and distinct methods for improving the swing of the baseball bat by the batter. These references specifically describe some sort of rotating means that can be applied to the bat. The two mentioned patents described improved rotating devices that can be applied after the manufacture of the bat. These elements comprise double layered elements which have a slip surface (which faces the handle of the bat) and a non-slip surface which is either gripped by the user or is applied under a gripping sleeve and is then gripped by the user. In the latter invention, a notching means is provided so as to prevent twisting and slipping of this particular grip during use.

In the case of my co-pending applications, devices are described which include a longitudinal split and the elements comprise either a single layer of a tube of flexible, slippable, pliable plastic (U.S. Ser. No. 07/829,269, now allowed) or a double layered element which has a first, outer layer comprised of a low slip material and a second, inner layer comprised of a high slip material (U.S. Ser. No. 07/853,572).

By installing the devices of any of these inventions on the handle of a conventional baseball bat, the swing of the user can be improved considerably as well-described therein. It has been found, however, that when either of the split elements is used by a strong individual (the so-called "heavy hitter") they tend to twist or distort and neither have the internal strength to survive many uses by these strong individuals. The teachings of this cross-referenced prior art is incorporated herein by reference.

SUMMARY OF THE INVENTION

It is an object of this invention to provide a simple, inexpensive yet improved gripping means for the handle of a baseball or softball bat and one that can be applied on said handle either after or during the manufacture thereof. It is also an object of this invention to provide an improved gripping means applied on the handle of any of the conventional baseball or softball bats. It is yet another object of this invention to provide such a gripping means that presents a hard and firm surface and one that will not twist or distort or slip during use by stronger batters. These and yet other objects are achieved in a baseball or softball bat used for playing baseball or softball in a swingable manner comprising in order a hitting or barrel end and a handle end, said handle end being grippable by both hands of the user thereof, said handle also having a knob end and a gripping sleeve applied thereon, and wherein a swing enhancing device is placed over said handle and under said gripping sleeve, said device comprising a thick, long tubed element of a slippable plastic, said element having a longitudinal split to provide ends in a longitudinal direction, said device designed to fit under one of the hands of said user, the improvement comprising wherein an interlocking tab is provided along said longitudinal split.

DETAILS OF THE INVENTION

Figure 1:
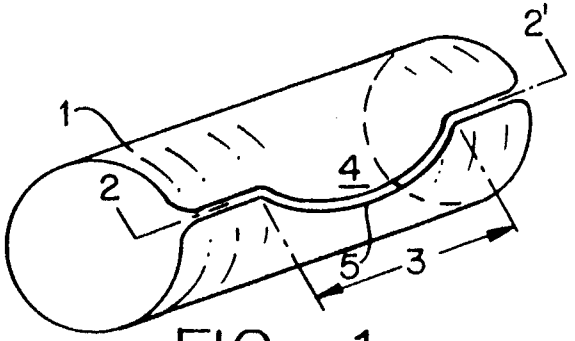
FIG. 1 is a showing of the swing enhancing device of this invention (hereinafter referred to as an "interlocking split grip").

Referring now specifically to the drawings which particularly exemplify the baseball or softball bat of this invention and the unique interlocking swing enhancing device employed thereon, FIG. 1 is a showing of the preferred version of the swing enhancing device or interlocking split grip of this invention. In this showing, 1 is the swing enhancing device of this particular invention, which is split along 2–2' and the area shown as 3 comprises a typical interlocking device to insure that the grip stays in place during use. In this figure, the interlocking device is shown as a tab 4 which is inserted in a matching indent 5. The corners of the longitudinal split at the ends are curved or rounded in this particular embodiment.

Figure 2:
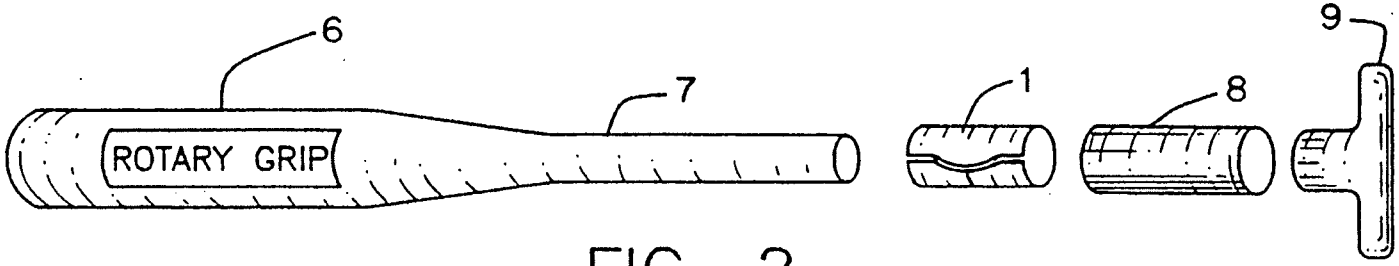
FIG. 2 is a showing of the various parts of a baseball bat including the interlocking split grip from FIG. 1.

FIG. 2 shows the various parts of a typical baseball or softball bat which will incorporate the swing enhancing device of this invention. In this figure, 1 is the device, 6 is the barrel of the bat, 7 the handle, 8 a flexible, rollable gripping sleeve which goes over the handle after installation of the device 1, and 9 is the knob.

Figure 3:
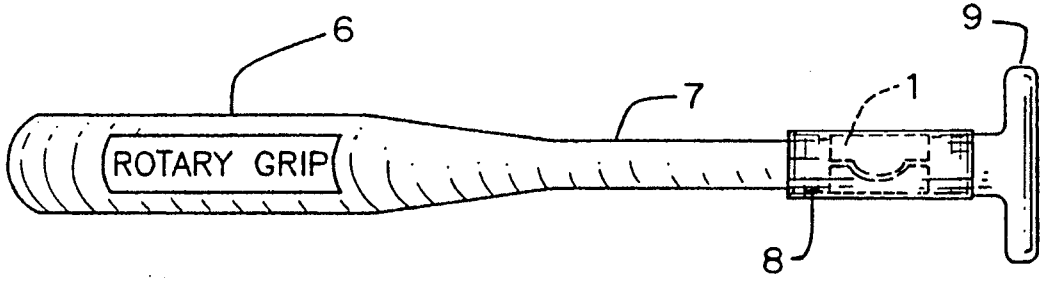
FIG. 3 is a showing from FIG. 2 with all of the parts assembled.

FIG. 3 shows the entire bat assembled. In this showing, since the device of this invention 1 is underneath the gripping sleeve 8, it is shown using dotted lines.

The device of this invention can be manufactured from a myriad of rigid and hard plastic materials. Preferably, the device is made from an ultra high molecular weight and dense polymer such as polyethylene; methacrylates; among others. A particularly preferred material is an ultra high molecular weight (e.g., M.W. 2,000,000 or greater) polyethylene. These materials are semi-pliable yet rigid and firm and can be formed into the desired length and thickness in a tube-like format. Then, the tube can be cut into the users needed length (e.g., to fit the hand of the user) and split longitudinally as wanted.

At this point, an interlocking process is added to the manufacture by cutting the longitudinal split so as to present a tab and a matching indent along the split. In the drawings shown, this tab is somewhat curved in nature with the indent cut to match. However, the tab may be square or a longer, tongue like shape. This is not important. Only that the tab and indent match so that when the two are mated, the entire device will stay in place. When this interlocking mechanism is employed, any strong baseball or softball player can use this device without further problems of tearing or distorting the shape of the device, which tends to impede its' usefulness. The diameter of the tubing employed in the manufacture of the device of this invention, should be within the ranges of any of the commonly known baseball or softball bat handles in order to fit over the handle thereof. Prior to placing a gripping sleeve is placed over the split grip of this invention, the split grip may be adjusted to any position to suit the particular user or batter and the interlocking mechanism put in place. The split grip may be placed high in order to affect a so-called "choke-up grip" on the bat. It may also be placed in another position as desired. The split grip is intended to fit one of the hands of the batter, the hand that is highest up on the grip, and may be used by either right- or left-handed batters as well. After the gripping sleeve is installed over the split grip, the upper hand of the batter will be over the device and the lower hand will not have any swing enhancing device thereunder. When used in this fashion, the gripping position of the hands will be maintained in the desired fashion ensuring that the swing is level and true. Thus, the batter will hit more line drives and less short, pop-up fly balls. The device can be made in usable lengths of 3 to 6 inches and can be of a thickness range from 10 to 75 mils, with a preferred thickness of 20 to 60 mils.

The device of this invention may be installed on a baseball bat during the manufacture thereof or it may be added to an already manufactured baseball or softball bat which employs a flexible, rollable gripping sleeve. In the latter instance, the gripping sleeve is simply rolled down and the device of this invention is parted along the split and installed at its desired location with the interlocking mechanism in place. Thus, the split grip of this invention is useful as an after addition by users thereof as well as to the baseball or softball bat industry.

Since the swing enhancing device of this invention is rigid and firm and possesses an interlocking split rigidly formed therein, any of the truly strong baseball or softball hitters can employ the device with the desired results.

I claim:

1. A baseball or softball bat used for playing baseball or softball in a swingable manner comprising in order a hitting end and a handle end, said handle end being grippable by both hands of the user thereof, said handle end also having a knob end and a flexible gripping sleeve applied thereon, and wherein a swing enhancing device is placed over said handle end and under said gripping sleeve, said device comprising a thick, long tubed element of a slippable plastic, said element having a longitudinal split to provide ends in a longitudinal direction, said device designed to fit under one of the hands of said user, the improvement comprising an interlocking tab provided along said longitudinal split.

2. The swing enhancing device of claim 1 wherein said longitudinal split is parallel the length of said tubed element and corners are formed at the ends thereof and said split is butted end-to-end along the length thereof and said tubed element comprises an indent for said tab along said longitudinal split.

3. The swing enhancing device of claim 2 wherein said tab has a curved shape and said indent matches said curve.

4. The swing enhancing device of claim 2 wherein corners are formed at ends of said longitudinal split and wherein said corners are rounded.

5. The swing enhancing device of claim 1 wherein said device has a length of from 3 to 6 inches and said device has a thickness of from 10 to 75 mils.

6. The swing enhancing device of claim 1 wherein said device has a length of 4 inches, and said device has a thickness of 40 mils.

7. The swing enhancing device of claim 1 wherein said plastic is a high density polyethylene.

* * * * *